United States Patent [19]

Jenkins

[11] Patent Number: 4,577,426

[45] Date of Patent: Mar. 25, 1986

[54] COMPOSITE LABEL WEB

[75] Inventor: William A. Jenkins, Englewood, Ohio

[73] Assignee: Monarch Marking Systems, Inc., Dayton, Ohio

[21] Appl. No.: 684,761

[22] Filed: Dec. 21, 1984

[51] Int. Cl.[4] ..... G09F 3/10

[52] U.S. Cl. ..... 40/21 R; 40/2 R; 40/21 A; 428/42; 428/137

[58] Field of Search ..... 428/40, 42, 43, 124, 428/137; 40/2 R, 21 A, 21 R

[56] References Cited

U.S. PATENT DOCUMENTS

| | | | |
|---|---|---|---|
| 3,170,830 | 2/1965 | Moberg | 156/489 |
| 3,885,334 | 5/1975 | Banks | 40/2 R |
| 4,081,309 | 3/1978 | Jenkins | 40/2 R |

*Primary Examiner*—Alexander S. Thomas
*Attorney, Agent, or Firm*—Joseph J. Grass

[57] ABSTRACT

There is disclosed a composite label web roll and a hand-held labeler for dispensing improved labels from the roll. The label is constructed and arranged so that the label can be folded to provide a tag such as a jewelry tag.

8 Claims, 6 Drawing Figures

FIG-5
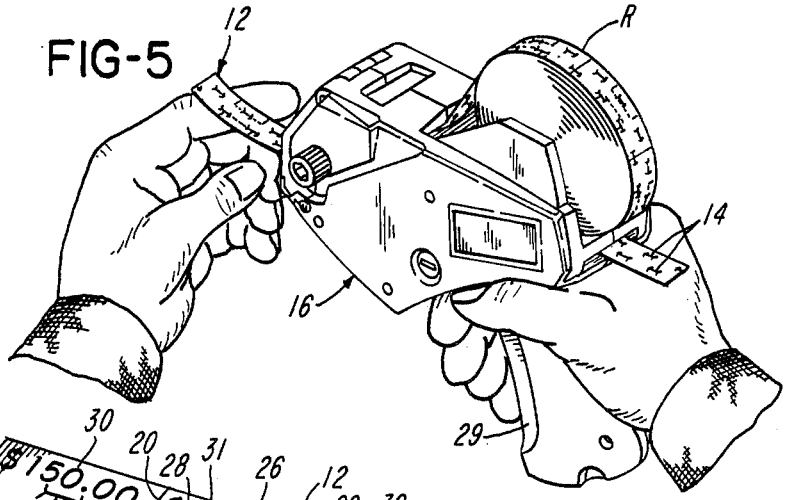
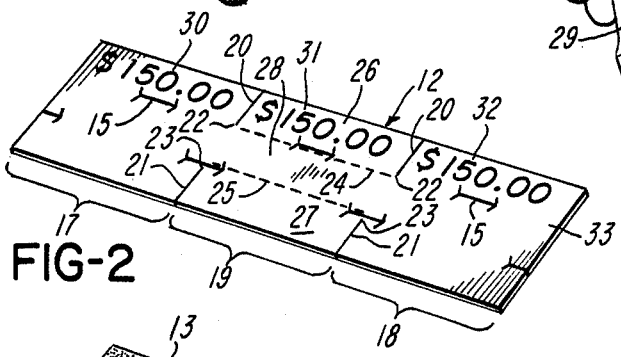
FIG-2
FIG-6
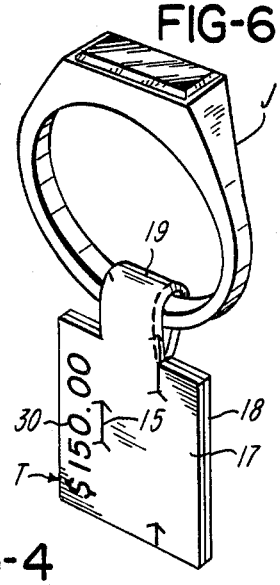
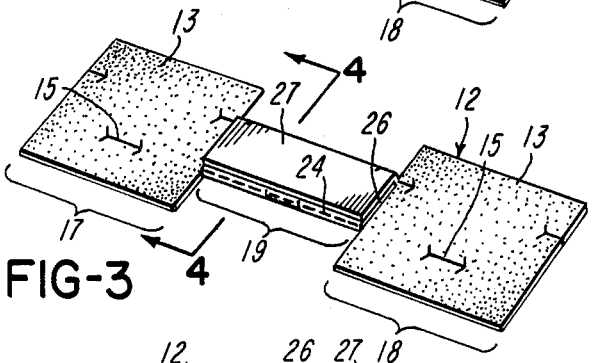
FIG-3
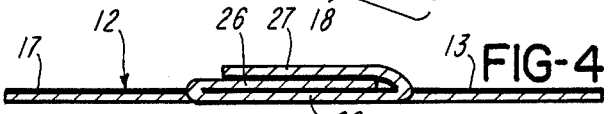
FIG-4
FIG-1
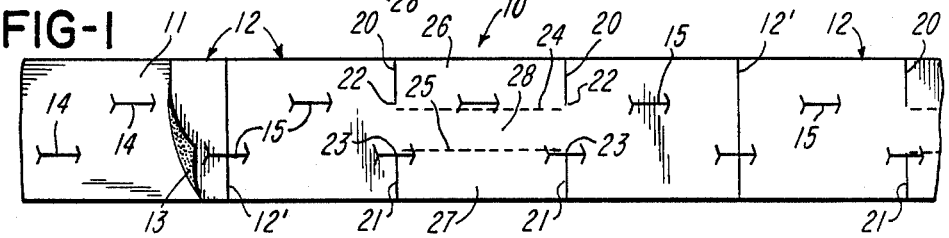

COMPOSITE LABEL WEB

BACKGROUND OF THE INVENTION

1. Field of the Invention

This invention relates to the art of tags and labels.

2. Brief Description of the Prior Art

The following U.S. Pat. Nos. are made of record: 3,021,630 granted Feb. 20, 1962 to A. H. Swett, Jr. and 3,170,830 granted Feb. 23, 1965 to S. M. Moberg.

SUMMARY OF THE INVENTION

This invention relates to an improved, low-cost composite label web which can be provided in roll form and which is capable of being printed and dispensed in a hand-held labeler. The label can be conveniently folded to provide a tag that is looped about an article. The tag can identify an article and/or it can bear a price such as a jewelry tag.

According to a specific embodiment of the invention, the composite label web includes a carrier web, and a series of improved labels. One side of the label is free of adhesive and the other side is releasably adhered by pressure sensitive adhesive to the carrier web. Each label has a longitudinal extent and lateral cuts defining a pair of longitudinally spaced end portions and an intervening central portion with at least one lateral tab. The tab is disposed between longitudinally spaced end portions of the respective label. The tab or tabs are foldable so that the adhesive thereon is adhered to a laterally adjacent part of the central portion and no adhesive on the central portion is exposed. The central portion can be wrapped about an article and the end portions brought into contact at their adhesive faces to provide a tag.

BRIEF DESCRIPTION OF THE DRAWINGS

FIG. 1 is a fragmentary top plan view of a composite label web in accordance with the invention;

FIG. 2 is a perspective view of a printed label like the one shown in FIG. 1;

FIG. 3 is a perspective view of the underside of the label shown in FIG. 2 for example with outboard tabs folded and adhered to each other;

FIG. 4 is an enlarged sectional view taken along line 4—4 of FIG. 3;

FIG. 5 is a perspective view of a hand-held labeler shown dispensing an improved label; and FIG. 6 is a perspective view of a label wrapped about a ring and folded into a tag.

DESCRIPTION OF THE PREFERRED EMBODIMENTS

With reference to FIG. 1, there is shown a composite label web generally indicated at 10 having a longitudinally extending carrier web 11 to which a series of longitudinally extending labels 12 are releasably adhered by pressure sensitive adhesive 13. The labels 12 are defined by butt cuts 12'. One side face of each label 12 has the adhesive 13, and the other side face is free of adhesive and is printable. The adhesive 13 is illustrated to be a continuous or full-gum coating, as is preferred, although pattern-gum coatings can be used if desired. The labels 12 are shown to be co-extensive in width to the carrier web 11. The labels 12 are shown to be rectangular and are substantially longer than they are wide. The carrier web 11 has feed cuts 14 which are aligned with tamper-indicating or tear-producing cuts 15 in the labels 12. The feed cuts 14 enable the composite web 11 to be advanced and dispensed in a labeler 16 of the type disclosed in U.S. Pat. No. 4,280,863 granted July 28, 1981 to Paul H. Hamisch, Jr. et al.

The label 12 has a pair of longitudinally spaced end portions 17 and 18 and an intervening central portion 19. The central portion 19 is defined by two pairs of lateral cuts 20 and 21 terminating at inner terminal ends 22 and 23. A line of weakening 24 extends between terminal ends 22 and a line of weakening 25 extends between terminal ends 23. The lines of weakening 24 and 25 are along fold lines that provide hinges. The cuts 20 define a tab 26 and the cuts 21 define a tab 27. The lines of weakening 24 and 25 help to define the longitudinal boundaries of the respective tabs 26 and 27 and provide defined hinges connecting the tabs 26 and 27 to a bridge or connecting member 28. The bridge member 28 connects the end portions 17 and 18 to each other.

As shown in FIG. 3, the tab 26 has been folded into face-to-face contact with and adhered to the bridge member 28 and the tab 27 has been folded into face-to-face contact with and adhered to the tab 26. None of the adhesive 13 on the central portion is exposed as is evident from FIG. 3. The central portion 19 can now be wrapped about an article such as a ring J as shown in FIG. 6, and the end portions 17 and 18 adhered to each other by means of the adhesive 13. The label 12 has now been folded into a tag T sometimes referred to as a jewelry tag.

The composite web 10 is preferably in the form of a roll R. The labeler 16 has a hand lever 29 which is operated three times to dispense the label 12. The first operation of the lever 29 causes indicia 30 such as the price $150.00 to be printed on end portion 17 and causes the carrier web 11 to be advanced through a distance of about one-third the label length to dispense the end portion 17. The second operation of the lever 29 causes indicia 31 to be printed on the tab 26 and causes the carrier web 11 to be advanced through a distance of about one-third the label length to dispense the central portion 19. The third operation of the lever 29 causes indicia 32 to be printed on the end portion 18 and causes the carrier web 11 to be advanced through a distance of about one-third the label length to dispense the end portion 18. In the dispensed position of the end portion 18, the trailing marginal edge 33 of the label 12 is still adhered to the carrier web 11. The label 12 can be lightly pressed between the user's index finger and thumb and pulled from the carrier web 11. It is preferred that the end portion 17, the central portion 19, and the end portion 18 be of the same length, that is, each portion 17, 18 and 19 accounts for one-third of the label length. As shown, the end portions 17 and 18 are of the same size.

Although the composite label web 10 of the invention is shown in roll form, the novel labels 12 can also form part of a fan-folded computer composite label web with tractor feed holes and the labels 12 can extend either longitudinally or laterally on the computer label carrier web.

Other embodiments and modifications of this invention will suggest themselves to those skilled in the art, and all such of these as come within the spirit of this invention are included within its scope as best defined by the appended claims.

I claim:

1. A composite label web, comprising: a longitudinally extending carrier web, a series of labels having one side free of adhesive and the other side releasably adhered by pressure sensitive adhesive to the carrier web, each label having longitudinally spaced lateral cuts defining a central portion with at least one lateral tab and a pair of end portions, the central portion being disposed between the end portions, the tab being laterally foldable so that the adhesive on the tab can be adhered to a laterally adjacent part of the central portion and no adhesive on the central portion is exposed, and wherein the central portion can be wrapped about an article and the end portions brought into contact at their adhesive faces to provide a tag.

2. A composite label web as defined in claim 1, wherein the lateral cuts provide a pair of outboard tabs and an intervening bridge member connecting the end portions, and wherein one of the tabs can be folded into adhesive contact against the bridge member and the other tab can be folded into adhesive contact against the one tab.

3. A composite label web as defined in claim 2, wherein the lateral cuts include a pair of lateral cuts at each marginal edge of the label, wherein each pair of lateral cuts terminates at a pair of inner terminal ends, a line of weakening between each pair of terminal ends, and each line of weakening defining a hinge for the respective tab.

4. A composite label web as defined in claim 1, including feed cuts in the supporting material web.

5. A composite label web as defined in claim 1, wherein the labels are rectangular.

6. A composite label web as defined in claim 2, wherein the tab is rectangular.

7. A composite label web as defined in claim 3, wherein the tabs are rectangular and are of the same size.

8. A composite label web as defined in claim 1, wherein the adhesive is in a full-gum coating.

* * * * *